US007815361B2

(12) United States Patent
Lindblom

(10) Patent No.: US 7,815,361 B2
(45) Date of Patent: Oct. 19, 2010

(54) METHOD AND ARRANGEMENT FOR AUTOMATED COLOR MIXING

(75) Inventor: Bo Lindblom, Osby (SE)

(73) Assignee: Texo Application AB, Almhult (SE)

( * ) Notice: Subject to any disclaimer, the term of this patent is extended or adjusted under 35 U.S.C. 154(b) by 502 days.

(21) Appl. No.: 11/576,019

(22) PCT Filed: Aug. 16, 2005

(86) PCT No.: PCT/SE2005/001211

§ 371 (c)(1),
(2), (4) Date: Oct. 9, 2007

(87) PCT Pub. No.: WO2006/036096

PCT Pub. Date: Apr. 6, 2006

(65) Prior Publication Data

US 2008/0051936 A1 Feb. 28, 2008

(30) Foreign Application Priority Data

Sep. 27, 2004 (SE) ..... 0402318

(51) Int. Cl.
*B44D 3/08* (2006.01)
*B01F 11/00* (2006.01)
*B01F 15/02* (2006.01)

(52) U.S. Cl. ..... 366/136; 366/141; 366/209; 366/605

(58) Field of Classification Search ..... 366/110, 366/111, 114, 208–217, 219, 605, 141, 136–137; 141/329; 53/50
See application file for complete search history.

(56) References Cited

U.S. PATENT DOCUMENTS 2,923,438 A * 2/1960 Logan et al. ..... 222/2
4,335,759 A * 6/1982 Pattiniemi et al. ..... 141/5
4,403,866 A * 9/1983 Falcoff et al. ..... 366/132
5,116,134 A * 5/1992 Edwards et al. ..... 366/208
5,203,387 A * 4/1993 Howlett et al. ..... 141/103
5,268,849 A * 12/1993 Howlett et al. ..... 700/226

(Continued)

FOREIGN PATENT DOCUMENTS

EP 1388365 A1 * 2/2004

(Continued)

*Primary Examiner*—Charles E Cooley
(74) *Attorney, Agent, or Firm*—Connolly Bove Lodge & Hutz LLP

(57) ABSTRACT

In a method for automated colour mixing in a customer-operated and enclosed arrangement, a container with colour base component can be inserted and shaken, the tin with the shaken colour base component is provided with a hole, one or more doses of colour pigment are added via the hole, the hole is closed and shaking is then carried out again. Devices for carrying out the said functions are controlled by microcomputer equipment that is arranged to work interactively with the customer. The making of the hole is carried out using a knife edge or injection device that penetrates the material of the container. The dosing of the colour pigments is carried out by means of a pump and valve arrangement in which one or more valves are opened and closed or by means of a pressure or piston arrangement. The dosing is initiated in the open state of the valve or by activation of the pressure or piston device. The invention also relates to an arrangement and has the advantages provided by optimal hole-making and dosing functions.

12 Claims, 4 Drawing Sheets

U.S. PATENT DOCUMENTS

| | | | | |
|---|---|---|---|---|
| 5,493,840 | A * | 2/1996 | Cane | 53/50 |
| 5,784,854 | A * | 7/1998 | Mazzalveri | 53/50 |
| 6,969,190 | B1 * | 11/2005 | McClain et al. | 366/141 |
| 2008/0257446 | A1 * | 10/2008 | Oakes | 141/1 |

FOREIGN PATENT DOCUMENTS

| | | | |
|---|---|---|---|
| EP | 1439000 | A2 * | 7/2004 |
| WO | 2006/008590 | A1 * | 1/2006 |

* cited by examiner

METHOD AND ARRANGEMENT FOR AUTOMATED COLOR MIXING

CROSS-REFERENCE TO RELATED APPLICATIONS

This application is a National Stage of PCT/SE2005/001211 filed Aug. 16, 2005 which in turn claims priority from Swedish Application 0402318-0, filed Sep. 27, 2004 disclosure of which is incorporated herein by reference.

TECHNICAL FIELD

The present invention relates to an arrangement for automated paint mixing in a customer-operated and enclosed arrangement in which a container, for example a tin, with colour base component(s) is inserted and is provided with a hole, one or more doses (quantities) of colour pigment are added via the hole, the hole is closed and shaking is carried out, and in which making the hole, dosing, closing and shaking are carried out by means of devices that are controlled by computer equipment, preferably microcomputer equipment, that is arranged to work interactively with the customer. The invention also relates to a device for such automated colour mixing.

BACKGROUND OF THE DISCLOSURE

Methods and arrangements for automated paint mixing are previously known, among other things through equipment provided by the same applicant. In connection with making holes, it has been previously proposed that the holes should be made by means of a punch device. Arrangements for dosing colour pigment into the tin's base component or base component mixture via the hole that has been made in the tin are also known. For automated paint mixing that works well, it is, however, important that all the functions can be carried out in an optimal way. The proposed punching method is not an optimal way of making holes for all types of tin and all types of material for tins. There is also a desire to be able to make holes in currently available materials for tins such as plastic, cardboard, sheet metal, etc. Concerning the function for dosing of colour pigment, it is important to be able to meet a requirement for more possibilities for colour mixing by means of control functions associated with the utilized microcomputer function.

SUMMARY OF DISCLOSURE

The object of the present invention is to solve the problems described above.

In a method according to the invention, the hole is made by means of a knife edge that is pushed through the lid of the container or tin and caused to follow or achieve a path that creates the shape of a hole and thereafter the dosing of the colour pigments is carried out by means of a pump and valve arrangement in which one or more valves are opened and closed. The dosing is initiated in a first state of the respective valve; for example the valve's opened state, while in a second state of the respective valve, for example the valve's closed state, recirculation of the colour pigment or pigments in the canisters allocated to the pigment or pigments takes place. One or more injection devices can also be used for making the hole and for adding the colour pigment, with a needle-shaped device that penetrates through the material of the container in a place where this is completely or partially of a softer type, for example cardboard, plastic (for example Ecolean), etc.

The addition of the colour pigment is achieved by means of a piston function and/or pressure function in the respective injection device.

The principle characteristics of the method relate to a method for automated color mixing in a customer-operated and enclosed arrangement (1, 2, 3, 4), in which a container (10) with a color base component(s) (23) is inserted and is provided with a hole (22) and one or more doses of color pigment are added to the container (10) via the hole and the hole is closed, with making the hole, dosing and closing being carried out by means of devices that are controlled by microcomputer equipment (5) that is arranged to work interactively with the customer. According to the method, the container is also shaken by means of the said device that causes shaking movements to be carried out, in that the hole is made by a knife edge/blade (11), injection device (64) an or punch device (60) that is pressed or forced through the material of the container, where in the ease of the said knife edge/blade, this is caused to make the hole or participates in the making of the hole, after which an arrangement with pump or pressure and one or more valves (31) is caused to carry out the addition of the color pigment, and in the case of the punch/injection device (64), the addition of the color pigment (24) is achieved by a piston function or ssure function, and in that recirculation is carried out of the color pigment or pigmments (24) in the canisters or injection devices (28, 69, 70, 71) allocated to these when the valve/valves or piston/device for operating the piston function or pressure function are deactivated or disconnected.

In further developments of the concept of the invention, the device that makes the hole is arranged with a clamping or fixing device that prevents the tin from moving with the knife edge or knife blade while the hole is being made. The knife or the knife edge can be arranged in a rotating unit that is rotated with the knife or knife edge penetrating the lid while the tin is clamped against a base comprised in the arrangement. Alternatively, the knife blade can be stationary and the tin can be arranged to rotate. In one embodiment, the knife blade and the tin are moved in opposite directions. The number of canisters that are provided with colour pigment of various types, for example colour pigment in paste form, and dosing quantities and/or dosing times are selected by the customer working interactively with the computer equipment or its operating devices (keypad, speech recognition equipment, etc). After each mixing of base component or base components and colour pigment, the canister or canisters, connecting pipes and valve or valves involved can be cleaned, preferably by means of a pump operating at high speed and a cleaning agent.

In an arrangement according to the invention, among other things the hole-making device is provided with a knife or knife edge that is arranged to be able to be pressed through the container or tin, preferably through its lid. The hole-making device is arranged to follow a path that creates a hole. The dosing device comprises a pump and valve arrangement with one or more valves that can be opened or closed and dosing is carried out in a first state, for example an open state, of the valve or valves. Recirculation in the canister or canisters concerned is carried out in a second state, for example a closed state, of the valve or valves. A set of canisters that are allocated colour pigments, comprising for example 24 canisters, can preferably be arranged to be included in the arrangement or can be connected to the arrangement. Alternatively, one or more injection devices can be utilized that are arranged to penetrate the material of the container and that are arranged to contribute to the carrying out of the addition of the colour pigment by means of their piston functions or pressure functions.

The principle characteristics of the arrangement relate to an arrangement for automated color mixing that is customer-operated and enclosed and in which a container (10, 18) with color base components(s) can be inserted, arranged for functions in the form of identifying, for example identifying the size and/or type, making of holes, addition of color pigment (24) and closing of the hole or holes, with the devices that carry out the functions being arranged to be controlled by means of computer equipment, for example a microcomputer (5), that works interactively with a customer. The functions of the arrangement also include shaking of containers (37) carried out by the said device, in that the hole-making device(s) consist of a knife (11) or knife edge, injection device (64) and/or punch device (60) arranged to be able to be pushed through the material of the container, where in the case of the knife edge/knife all, this is arranged to follow a path that creates a hole by means of the knife (11) or knife edge and the container (10) moving in relation to each other and in that the dosing or comprises an arrangement with pump or pressure and one or more valves (31) are activated or connected for the dosing to be carried out, and in the case of the punch (58)/injection device (64), one or more piston functions or pressure functions are arranged to carry out the addition of the color pigment, in that dosing is carried out in a first state, for example an open state, of the valve(s) or activated piston function or pressure function, and in that recirculation in the canisters (25) or injection devices is carried out in a second state, for example a closed state or deactivated state, of the valve(s) (31) or piston function or pressure function.

In further developments of the concept of the invention, the hole-making device can comprise a clamping or fixing device that interacts with the tin to prevent the tin following the movements of the knife or the knife edge when the hole is being made. The hole-making device can have a rotating part that supports the knife or knife edge. Similarly, the clamping or fixing device can extend centrally through the rotating part in its longitudinal direction. The clamping or fixing device can be arranged to be sprung in its longitudinal direction. The inserted container can be identified for determining the size, type, number of colour pigments that are to be added, the shaking time, hole-making function, etc, by means of the microcomputer. Additional further developments are apparent from the following subsidiary claims.

What is proposed above has advantages provided by optimal hole-making and dosing functions being able to be obtained. The hole-making device can function in a non-critical way, even for tin materials that are difficult to open, such as plastic, cardboard, sheet metal, etc. The dosing arrangement can be implemented efficiently as far as quality is concerned for paint mixtures while, at the same time, effective control can be carried out by the customer from the operating devices on the microcomputer. Efficient calibration and cleaning functions can be utilized in this connection.

A currently preferred embodiment of a method and an arrangement that have the significant characteristics of the invention will be described below with reference to the attached drawings in which

DESCRIPTION OF VARIOUS AND PREFERRED EMBODIMENTS

Figure 1:
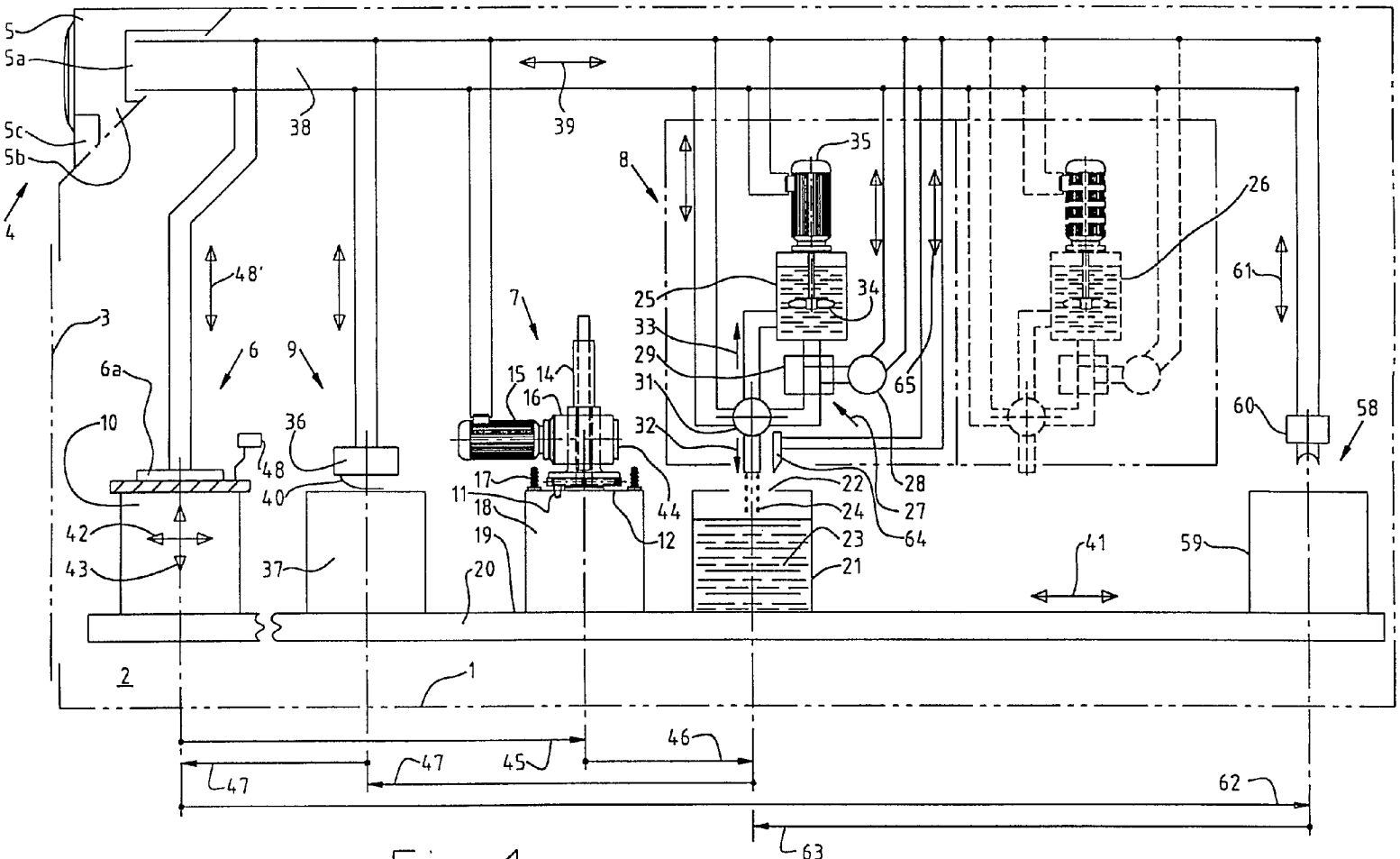
FIG. 1 shows in the form of an outline diagram, an arrangement for automated colour mixing that the customer himself can utilize without significant assistance from service personnel in the shop.

FIG. 1 shows a unit indicated by 1. The unit comprises an internal space 2 arranged for automated paint mixing. The unit is to be able to be installed in a shop and to be used by the customer himself, if necessary in consultation with the shop personnel. The unit comprises an opening or door 3 and a panel that is symbolized by 4 and that comprises operating devices 5, by means of which the automated paint mixing is to be able to be carried out by means of interactive working with the customer or other person. The operating devices 5 or the operating part comprise a known microcomputer. The unit works with a number of stations, namely a combined identifying and shaking station 6, a hole-making station 7, a dosing station 8 and a labelling station 9. The station 6 comprises a shaking device shown in outline that can shake a container, for example a tin 10, that is closed and contains one or more colour base components. In an initial stage, in association with putting the container or the tin into the unit 1, identification is carried out in the station 6, for example by means of detection of the size of the lid of the tin or the like, or by detection of the size of the container or tin. This identification forms the basis for the dosing quantity and the hole-making function that is carried out by the subsequent stations. The hole-making station 7 can work with a knife or knife edge 11 that can penetrate the lid 12 of a tin that has been transferred to the station, which tin is, for example, made of cardboard or plastic and contains a colour base component or colour base components. The hole can be made in other places on the tin and, for example, the tin can be inverted and the hole can be made in the bottom of the tin. The knife 11 is arranged on a rotating part which, in turn, is rotated by a part 14 connected to a rotation unit, for example an electric motor 15 that interacts with the unit 14 via a cog arrangement or belt arrangement 16. The cog arrangement or belt arrangement on the motor 15 and the unit 14 can be designed in a known way. In the embodiment, the hole-making device is also provided with a fixing device that clamps the tin 18 or the like against the top surface 19 of a supporting device 20. The clamping device 17 is arranged to prevent the tin 18 following the movements of the knife or the knife edge 11 while the hole is being made by the knife or knife edge 11. FIG. 1 also shows a tin 21 at the dosing station 8, which tin has been provided with a hole 22 in the station 7. The colour base component in the tin 21 has been symbolized by 23 and colour pigment that is symbolized by 24 is to be added in the dosing station 8. The dosing station comprises a number of canisters, for example 24 canisters, one of which has been illustrated with solid lines designated by 25 and one of which is shown by broken lines and symbolized by 26. The set of canisters can be integrated into the unit 1 or connected to this via pipes in a known way. Each canister can comprise a pump arrangement 27 with a pump motor 28 that drives a propulsion device 29 for colour pigment in the canister 25. The arrangement also comprises a valve 31 that can assume two positions in response to controls, where dosing into the tin 21 is carried out in the first position and where recirculation takes place in the canister 25 in the second position. The dosing function is symbolized by an arrow 32 and the recirculating function by an arrow 33. The canister 25 also comprises a stirrer 34 that is driven by an electric motor 35. Other canisters 26 can be constructed in a corresponding way. The labelling station 9 can be provided with a known labelling device 36. FIG. 1 shows a tin 37 that assumes a position in the said station 9. In FIG. 1, different tins have been shown in the different stations for the sake of clarity. However, the mixing process involves the unit 1 handling one tin or the like at a time, which tin is transported between the different stations by means of the conveyor device 20. Thus, a tin that is inserted by the customer via the door 3 goes to the first station 6 where identification is carried out and, after the identification, the same tin is transferred to the station 7 where the making of the hole is carried out. After the making of the hole, the tin is transferred to the station 8 for dosing, after which the tin provided with colour pigment is transferred to the final station 9 for closing. After the closing has been carried out, the tin is returned to the station 6 where shaking of the container and its contents is carried out. FIG. 1 shows a lead connection or bus 38 via which the microcomputer 5*a* controls the devices at the stations 6, 7, 8 and 9 via operating and feedback signals that are symbolized by arrows 39. A closing device 40 is shown at the station 9. In the embodiment, the base 20 can be moved in the directions of the arrows 41 and, in one embodiment, can be fixed, with the stations and/or the tins 6-9 being able to be moved in the directions of the arrows 41. The tin 10 or the device 6*a* can be caused to shake with different vibrations or frequencies in the directions of the arrows 42 and 43 (in horizontal or vertical directions) and/or in other directions. The rotation device 14 can be arranged in a fixed framework 44. The direction of movement for a tin from the station 6 to the station 7 is shown by 45. The directions of movement for a tin between the stations 7 and 8, and between the stations 8 and 9 are indicated by 46 and 47 respectively. The base or the tin conveyor 20 can be controlled horizontally and/or vertically.

In the embodiment according to FIG. 1, an inductive detection device 48 is shown that detects the type (plastic, sheet metal, etc) of the tin 10 and can thereby indicate the type of the tin as such. The inductive detection generates signals 48' to the microcomputer.

Figure 2:
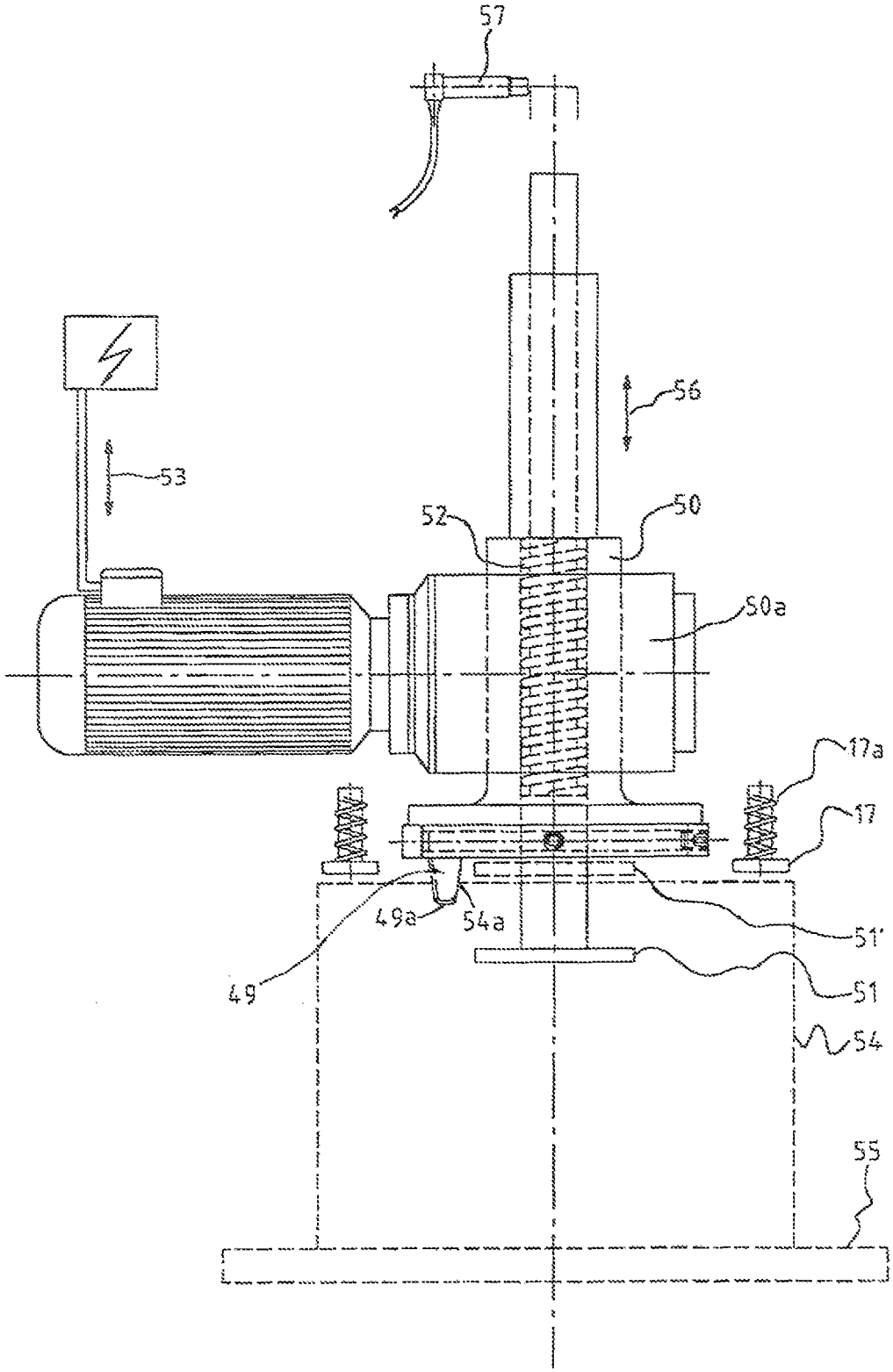
FIG. 2 shows a hole-making device in side view and elongated.

FIG. 2 shows a hole-making device. A knife blade with holder is indicated by 49, and a holder for a knife and gearbox are indicated by 50 and 50*a* respectively. The reference numeral 51 indicates a pressure plate and the reference numeral 52 indicates a spring. For the hole-making function, the holder can rotate in the direction of the rotational arrow 53. The knife blade 49 is chamfered on the inside and at the bottom, see the chamfer 49*a*. This means that the hole has the same diameter as the knife. If the chamfer were to be on the outside, the hole would be smaller than the diameter of the knife. The holder 50 passes through the gearbox 50*a* and is driven by this. The speed of cutting is controlled by the speed of the tin against the knife. This is carried out with a frequency converter. The pressure plate 51 presses down the piece of plastic that has been cut out. It also tensions the plastic lid so that the cutting is made easier. In addition, a sensor 57 is included that can indicate whether a hole has been made. FIG. 2 also shows how the pressure plate is pressed up to a position 51 in which it interacts with the top surface 54*a* of the tin 54 when the tin, is set up on a base 55. The hole-making device can also be moved in its longitudinal direction in the directions of the arrows 56. The cut-out piece of plastic has been symbolized by 54*a*'. Clamping devices are indicated by 17 and springs comprised in the clamping devices are indicated by 17*a*.

A station with a punch function is symbolized by 58. A tin made of a harder material (metal sheet) is indicated by 59 and the punch device is indicated by 60. The punch function and selection of punch function is carried out by means of the microcomputer. There is an exchange 61 of signals between the microcomputer and its detections of tin/container inserted in the station 6 and also the punch station when this is to be utilized.

In an embodiment, the arrangement is combined with a colour tinting unit (dispenser) that contains a maximum of 24 colour containers for different pigment (paste) colours. Pigments are dosed into the base colour and are then mixed together to create the required colour tint. These tints have different formulae in which different quantities of pigment are dosed depending upon the colour tint. In order to create the correct tint, the formula must be converted to a mathematical calculation of how long dosing is carried out. When dosing is carried out, a pump/colour container is operated that pumps against a valve. When the valve is closed, the paste is recirculated back into the container and when the valve is open, paste is dosed into the paint tin. The time that the valve is open depends upon the quantity of paste that is to be dosed. All the data is stored in an access database 5*b*. According to the invention, all functions relating to dispensing are carried out via PC-based programs.

The microcomputer and its controls comprise a service menu for settings for the dispensing and invocation of the functions described below. Among other things, there are indications of intervals and lengths of time for the recirculation of paste, which is programmed in a menu for recirculation. When recirculation is carried out, the paste is circulated from a canister via a (closed) dosing valve back into the canister, while at the same time a stirring device (paddle) operates inside the canister. In addition, there is a menu for setting up the paste colours (that is colour pigment doses). The canister number can be selected for setting the colour. An RGB code is shown for the paste with which the canister is filled. The RGB code is used to display the colour tint on a touch screen. In addition, there is a menu for paste replenishing. Before the process can commence, paste must be replenished in the canisters and entered in the database via the touch screen. The quantity of paste is given in grams and, when dosing is carried out in the process, a running total is kept to see whether the calculation point has been reached and monitoring is also carried out so that it is not possible to dose if the quantity of paste is less than the level that is required. A menu for canister content shows the content in the canisters, and also buttons for selecting the canister to be replenished. There is also a menu for paste replenishing showing the additional quantity of paste. By means of a menu for a cleaning program, cleaning of pipes and nozzles can be carried out by operating a start button. The system starts a pump at high speed and opens one valve at a time for cleaning. Only valves/canisters that have been involved are cleaned. Calibration of paste can be carried out. The different pastes have different specific gravity/units of volume per litre, which is taken into account when dosing is carried out. Accordingly, all the pastes must be calibrated for the correct dosing quantity when colour tinting is carried out. The calibration involves the quantity of paste (in grams) in relation to the time being monitored at low and high speed. A separate menu in the software is used for the calibration. In this, it is possible to select first which paste is to be calibrated, for example no. 8 (RS) red paste with specific gravity 1600 g/1000 ml. Calibration of a valve can be carried out by means of a menu. The paste is calibrated at low pump speed, for example during operation for 1 second followed by operation for 5 seconds, and the quantities of paste that are dosed during the abovementioned periods of time are weighed using calibrated weighing equipment. When this has been carried out, an average value is calculated for dosing according to the formula below:

Calibration: 1 second—1.5 grams at low speed 5 seconds—7.8 grams at low speed

According to the calculation below, the calibrating factor at low speed is: Total grams/Total time (1.5+7.8)/(1−+5) Calibrating factor, low speed=1.55 gr/s The same procedure as above is also carried out at high pump speed.

Calibration: 1 second—2.4 grams at high speed 5 seconds—12.5 grams at high speed According to the calculation below, the calibrating factor at high speed is: Total grams/Total time (2.4?12.3)/(1+5) Calibrating factor, high speed=2.45 gr/s For paste dosing<5 gr, low speed is used and For paste dosing>5 gr, high speed is used, which is controlled by the software.

A test menu in which a valve can be checked against weighing equipment can be utilized. A selection can be made of the paste/valve that is to be tested. The required quantity of paste that is to be dosed is indicated in grams. The start button is pressed and the dosing procedure commences (the pump starts, there is a delay until the pump has reached the correct speed, the valve opens, the valve closes and the pump stops) and the result from the weighing equipment is displayed on the touch screen. A comparison is carried out between the desired value and actual value and, if the difference is too great, a new calibration of the valve (paste) should be carried out. There can be a menu for tin parameters. The different tins that are used in the process must be parameterized for correct transportation through Genius. This is in order to enable the different phases to be carried out, like making holes, dosing and labelling. Parameters are given in a table in which the different types of tin are shown separately. In a main menu, dosing of paste into the base colour is carried out by the customer himself by giving different parameters for dosing via the touch screen. In the main menu, "RECIPE" is pressed for the first step in the process. The recipe number is given for the required colour tint (obtained from a colour chart in the shop) with the ability to change the tint by a percentage increase or reduction in the proportion of paste in the recipe. When the start button is pressed, the process starts and the paint tin is transported through Genius to the different stations. During the process, the different phases of the process are displayed on the touch screen and these can be followed as they are indicated in sequence. The formula from the paint supplier or consultant for a colour tint is based on a particular quantity of base colour, for example 9000 ml. These formulae for colour tints are stored in a database such as Access. For different tin sizes (quantities of base colour), the formula is recalculated so that the correct quantity is dosed. It is checked that there is a sufficient quantity of paste in the containers for the selected recipe and tin size. If this is not the case, the process stops and the operator (customer) is alerted. When the process approaches the dosing phase, the pump is started in order for it to attain precisely the correct speed for dosing either at low speed or high speed, depending upon the quantity that is to be dosed.

Red colour with recipe no. 090 80 40 is to be dosed in a 1 litre tin.

Recipe formula=240 ml red paste 8 (RS) for 8000 ml base colour.

$$\text{Volume to dose} = \frac{950(\text{ml}) \times 240(\text{ml})}{8000(\text{ml})} - 25.5(\text{ml})$$

Weight to dose=28.5 (ml)×(1600 (g)/1000 (ml))=45.6 (g)

Speed of pump=high speed when dosing is >5 g

Time to dose 45.6 (g)/2.45 (g/sec)=18.61 (sec)

(2.45 g/sec calibrating factor, see above in the text)

This amendment is printed out on the customer label so that it can be repeated at the next purchase of the same colour tint. A menu for manual operation of the tin handling can also be used.

Service menu for handling of tins manually through the different phases of Genius.

The pressure plate in the shaking device can be moved up or down.

The tin conveyor can be moved vertically and horizontally.

The knife for cutting holes in tin lids can be operated manually.

Manual advancing of tin conveyor excluding dosing. Display of positions for the different movements excluding the knife.

In a menu for shaking settings, the individual setting of pressure (clamping plate against the lid) and shaking time for the different types and sizes of tin can be carried out. It is possible to clamp the tin and to shake the tin in accordance with values that are entered manually. Finally, menus for alarms and choice of language can be used.

In the case of the punch 60, the tin is moved from the station 6 to the station 58 in accordance with the arrow 62 and from this station 58 to the dosing station 8 in accordance with the arrow 63, after which labelling and shaking can be carried out.

Figure 3:
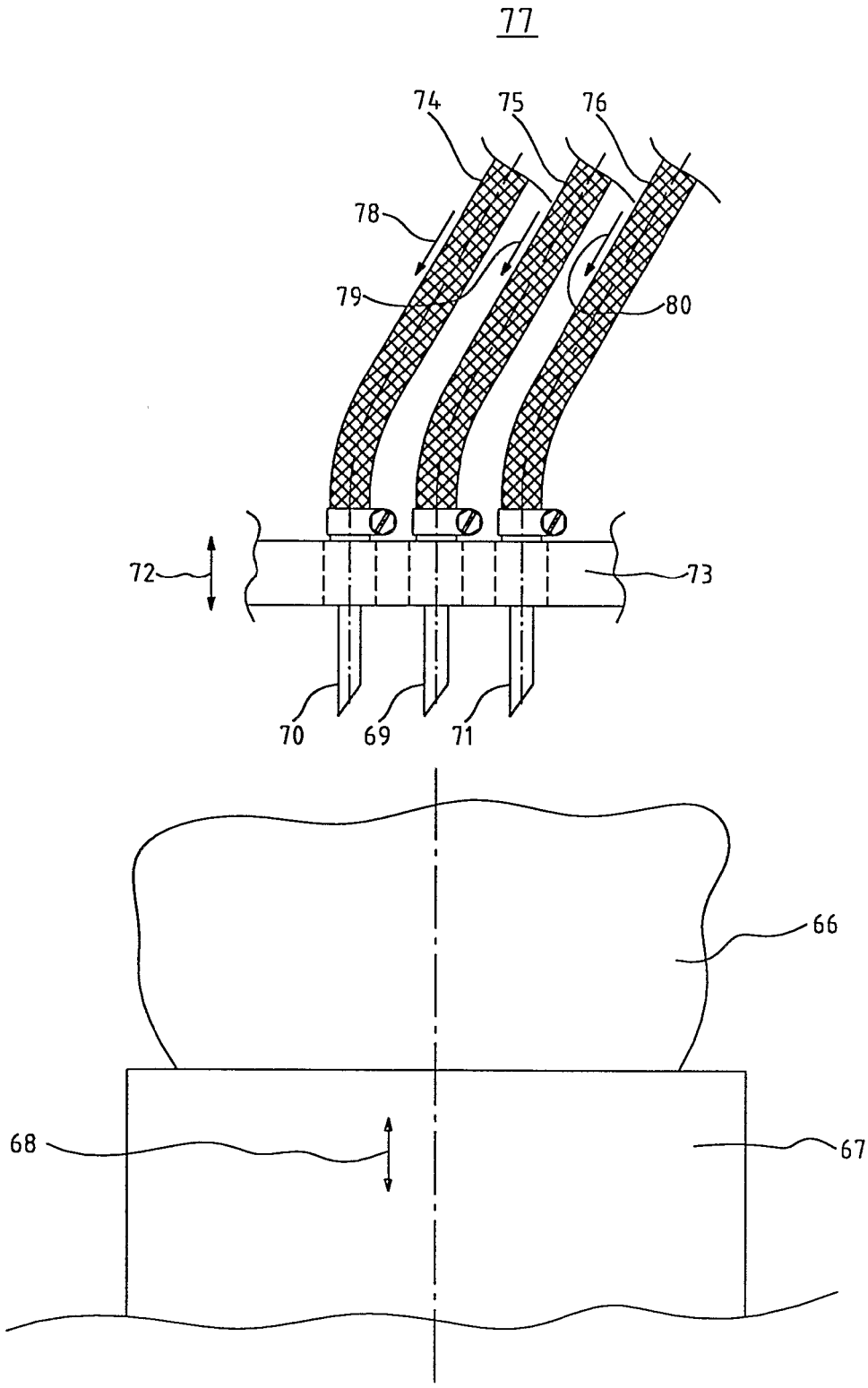
FIG. 3 shows in side view and in outline, a hole-making device in the form of an injection device that, in addition to having a needle function, also works with a piston function and pressure function for the addition of colour pigments in a hole or holes that have been made.

In accordance with FIGS. 1 and 3, one or more colour pigments can be injected into the container when this consists of a plastic shell or material shell that can be penetrated by one or more needle-shaped devices. In FIG. 1, a needle-shaped device is indicated by 64 and control signals, by means of which the device 61 and the microcomputer carry out an exchange of information, are indicated by 65. In FIG. 3, a container that is in the shape of a bag or is constructed of soft material is illustrated by 66. The base in the equipment for the container 66 is indicated by 67. The base can move in a vertical direction according to the arrows 68. Three needle-shaped devices have the reference numerals 69, 70 and 71. The container 66 can be pressed against the needles so that these penetrate through the material of the container 66. The needles can also be moved in a vertical direction in accordance with the arrows 72 and/or in a horizontal direction or in other directions. In this case, the needles are kept in the positions shown by a part 73. Alternatively, the needle(s) can be tilted up and down. The needles are connected to hoses/pipes 74, 75, 76 that lead from one or more colour pigment containers that are symbolized by 77. The colour pigments are taken from the containers in the directions of the arrows 78, 79 and 80. The part **54*a*'** is pressed down into the space inside the container when the holes are being made.

Figure 4:
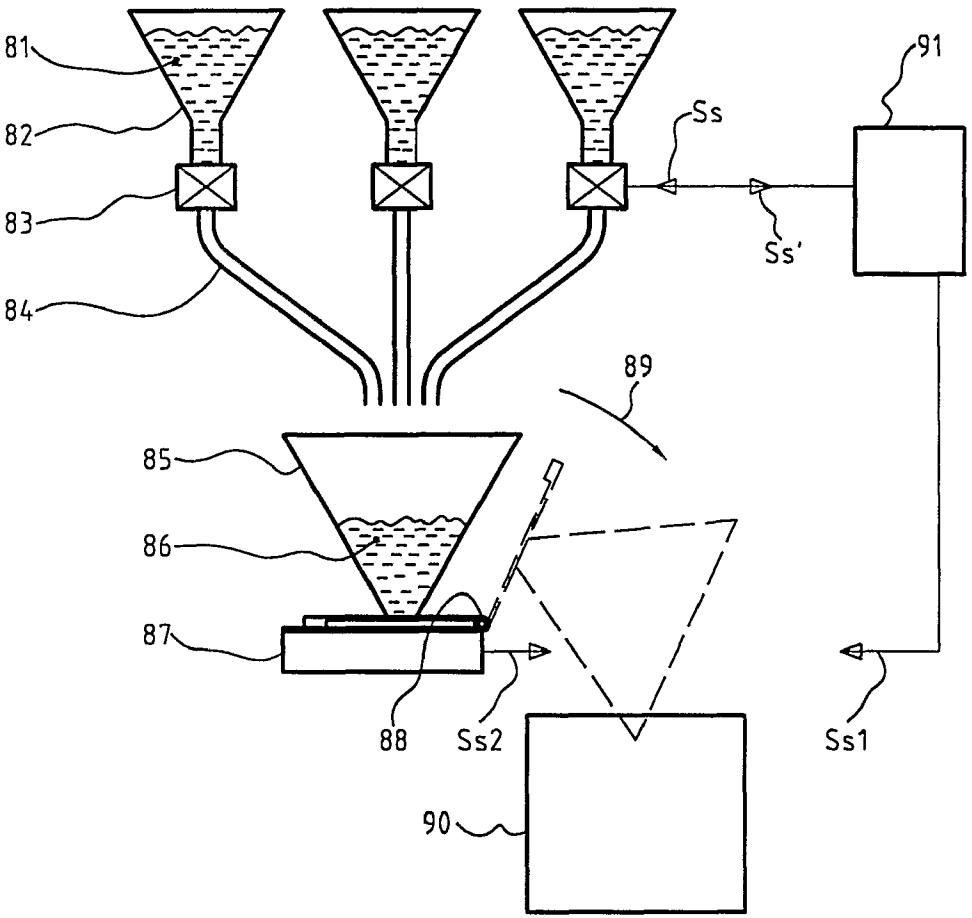
FIG. 4 shows in end view and in outline, the addition of colour pigment when the colour pigment is in the form of powder and is added by an arrangement with controlled valves, weighing and tipping devices.

In an alternative embodiment, or independently in relation to the equipment described above, the arrangement for automated paint mixing that is operated by a customer or service engineer comprises the ability to insert a container with colour base component or components. The arrangement operates in the same way as the above, with functions for identifying, for example identifying the size and/or type, making of holes, addition of colour pigment, closing of the hole or holes and shaking of the container. The devices in the arrangement that carry out the said functions are arranged to be controlled by means of the computer equipment described above, that can consist of a microcomputer (PC) that works interactively with the customer or service engineer. The arrangement can comprise or be connected to an arrangement for adding colour pigment in powder form. In accordance with FIG. 4, one, two, three or more colour pigment powders 81 are arranged in containers 82 belonging to the respective colour pigments, and there can be a different number of containers than of the colour pigment powders or a corresponding number. Valves 83, that are shown in outline, for dosing the colour powder or powders are arranged in association with the containers. In the embodiment illustrated in FIG. 4, a nozzle or nozzles 84 are also used that lead down to a pan or container 85 for colour pigment 86 that has been transferred to the pan or container or that has fallen down into the pan or container. The arrangement also comprises weighing equipment that preferably consists of electronic weighing equipment 87. A tipping device 88 that is shown in outline is arranged in association with the weighing equipment. The tipping function for the colour pigment or pigments weighed in the weighing unit 85 is shown in outline and symbolically by 89. Colour pigment is thus tipped down or transferred from the pan 85 into the container 90 or tin, which is provided with colour base component in accordance with the above. The said valves 83 are arranged to be able to be controlled from the computer equipment or personal computer or microcomputer, indicated in outline in FIG. 4 by 91. Control signals from the computer are illustrated by Ss and there can also be an exchange of signals in the opposite direction, that is from the valve or valves to the computer, which is symbolized by Ss'. The arrangement that can be incorporated in the embodiment shown above, can alternatively be arranged beside the arrangement as supplementary equipment. When the valve or valves 83 open, colour powder 81 falls down into the pan or container 85. The weighing equipment also communicates with the computer equipment 91 via control signals and signals that are exchanged Ss1 and Ss2. By means of this interaction, dosing of colour pigment can be carried out into the container/tin 9 with the correct quantity according to the recipe. When the correct quantity of the same or different colour powder pigments has been weighed out, the weighed colour powder pigments are tipped down into the hole made in the container or tin 90, compare the above. By means of the embodiment shown in FIG. 4, handling of colour pigment in powder form instead of colour pigment in liquid form can be utilized, which provides cleaner handling which simplifies the cleaning functions between carrying out the different mixing processes. The handling of the actual colour pigments is made also easier as the colour pigments can be transported and handled in bags, containers, etc, in a simpler way than if liquid colour pigment were to be used. The mixing of the colour pigments into the colour base component or components is also simplified. The size of the tin can be indicated by the final position that the clamping plate assumes. The movement of the clamping plate can be given as a number of pulses, which is transferred to the computer unit. In FIG. 4, the tipping positions of the pan 85 and the tipping device 88 are shown by broken lines.

The invention is not restricted to the embodiments described above, but can be modified within the framework of the following claims.

The invention claimed is:

1. Arrangement for automated color mixing that is customer-operated and enclosed and in which a container with color base component(s) can be inserted, an for functions in the form of identifying, making of holes, addition of color pigment and closing of a hole or holes, with device(s) that carry out the said functions being arranged to be controlled by means of computer equipment that works interactively with a customer, wherein the said functions also include shaking of containers to be carried out by the said devices(s), in that the hole-making deivce(s) comprise a knife or knife edge, injection device or punch device or both arranged for being pushed through material of the container, where in the case of the knife edge or knife, this is arranged to follow a path that creates a hole by means of the knife or knife edge and the container moving in relation to each other, and comprising a dosing device that comprises an arrangement with pump or pressure and one or more valves for activation or being connected for carrying out the dosing, and in the case of the punch or injection device, one or more piston functions or pressure functions are arranged for carrying out the addition of the color pigment, wherein the dosing is to be carried out in a first state of the valve(s) or activated piston function or pressure function, and in that recirculation in the canisters or injection devices is to be carried out in a second state of the valve(s) (31) or piston function or pressure function, and further comprising an arrangement for handling color pigment in powder form for the addition of color pigment and wherein the arrangement comprises a weighing device, and a tipping device for tipping the weighed powder into the container or tin with the base color.

2. Arrangement according to claim 1, characterized in that the hole-making device comprises a clamping or fixing device for interacting with the tin.

3. Arrangement according to claim 2, characterized in that the hole-making device has a rotating part that supports the knife or knife edge.

4. Arrangement according to claim 3, characterized in that each canister has a stirring device for activation during the said recirculation.

5. Arrangement according to claim 3, wherein computing equipment comprises a microcomputer and wherein the operating devices on the microcomputer are arranged to indicate the content in the canisters and comprise operating devices for selection of the canister or canisters that are to be replenished, wherein the operating devices are also arranged with calibration function for pastes (color pigment) taking into account specific gravity, units of volume per liter and correct dosing quantity when color tinting is carried out, when the paste calibration takes place during an initial stage at a low pump speed for a predetermined period of time that is followed by a stage with a longer period of time.

6. Arrangement according to 2, characterized in that each canister has a stirring device for activation during the said recirculation.

7. Arrangement according to claim 2, wherein said computing equipment comprises a microcomputer and wherein the operating devices on the microcomputer are arranged to indicate the content in the canisters and comprise operating devices for selection of the canister or canisters that are to be replenished, wherein the operating devices are also arranged with calibration function for pastes (color pigment) taking into account specific gravity, units of volume per liter and correct dosing quantity when color tinting is carried out, when the paste calibration takes place during an initial stage at a low pump speed for a predetermined period of time that is followed by a stage with a longer period of time.

8. Arrangement according to claim 1, characterized in that each canister has a stirring device for activation during the said recirculation.

9. Arrangement according to claim 1, wherein said computing equipment comprises a microcomputer and wherein the operating devices on the microcomputer are arranged to indicate the content in the canisters and comprise operating devices for selection of the canister or canisters that are to be replenished, and wherein the operating devices are also arranged with calibration function for pastes (color pigment) taking into account specific gravity, units of volume per liter and correct dosing quantity when color tinting is carried out, when the paste calibration takes place during an initial stage at a low pump seed for a predetermined period of time that is followed by a stage with a longer period of time.

10. Arrangement according to claim 1, characterized in that the arrangement has one or more containers for the powder or powders and one or more valves for the dosing of the powder or powders.

11. Arrangement according to claim 1, wherein the weighing device(s) comprises an electronic weighing device arranged to communicate with the computer equipment, and wherein the electronic weighing device is arranged to receive the pigment powder dosed by the valve or valves and powder transferred or failing form the valve or valves.

12. Arrangement of claim 1, wherein said closing device further comprises a labeling station having a labeling device configured to label the container, and further wherein said hole closing device is configured to close said hole or holes subsequent to said one or more doses of color pigments being added to the container in the dosing station but prior to said shaking of the container.

* * * * *